United States Patent [19]

Nish et al.

[11] 4,305,267

[45] Dec. 15, 1981

[54] KEY COVERS AND A RELATED SYSTEM AND METHOD

[76] Inventors: Terry E. Nish, 1150 Centennial Cir., Salt Lake City, Utah 84116; David J. Jones, 3827 S. 600 West, Bountiful, Utah 84010

[21] Appl. No.: 92,238

[22] Filed: Nov. 7, 1979

[51] Int. Cl.[3] ..... E05B 19/00

[52] U.S. Cl. ..... 70/395; 70/408; 70/460

[58] Field of Search ..... 70/395, 408, 460, 456–459; 40/330

[56] References Cited

U.S. PATENT DOCUMENTS 1,837,114 12/1931 Cicourel ..... 70/408
3,786,659 1/1974 Elder ..... 70/408

FOREIGN PATENT DOCUMENTS 197803 3/1978 Fed. Rep. of Germany ..... 70/408
197809 9/1978 Fed. Rep. of Germany ..... 70/408

*Primary Examiner*—Robert L. Wolfe
*Attorney, Agent, or Firm*—Lynn G. Foster

[57] ABSTRACT

Exchangeable key covers, and a related system and method, each key cover at least partially enclosing the proximal end of a hotel or like key, each cover being preferably formed of synthetic resinous material, such as polyethylene, and removably force-fit over the proximal end of the key to display room identification indicia and, if desired, other indicia, whereby no key interconnecting chains, tags or the like are required and the key covers are easily and accurately exchanged between keys in correspondence with rotation of the locks.

8 Claims, 8 Drawing Figures

KEY COVERS AND A RELATED SYSTEM AND METHOD

BACKGROUND

1. Field of Invention

The present invention relates generally to keys and more particularly to a system, a method and removable and exchangeable covers for the proximal end of hotel and like keys, which key covers provide room identification indicia and may be easily and accurately moved from key to key as hotel or like locks are rotated.

2. Prior Art

Hotel, motel and like keys have traditionally received room identification by either (a) die stamping the number into the material comprising the proximal end of the key or (b) placing the number upon a separate tag which is securely joined to the proximal end of the key by a chain or the like. When the first technique is used, the key must be discarded and a new one made and marked with the room identification each time the hotel locks are rotated (for security reasons, for example). When the second technique is used, the hotel guest is required to carry the resulting bulky and heavy key-chain-tag combination. This not only is awkward for the guest, it reduces to some extent the goodwill which would otherwise be created. Also, it is cumbersome to remove the tag and chain from the key and expensive when the tag-chain-key combination is inadvertently retained by the guest after check out and later mailed back to the hotel.

BRIEF SUMMARY AND OBJECT OF THE INVENTION

In brief summary, the present invention comprises a removable and exchangeable cover for the proximal end of a hotel or like key which displays room or like identifying indicia and which obviates the need for die stamping such indicia directly upon the proximal end of the key and eliminates reliance upon bulky indicia tag-chain-key combinations. A related system and method are also provided.

Accordingly, it is a primary object of the present invention to provide a novel cover for the proximal end of a key.

A further significant object of the present invention is to provide a novel cover for removable and exchangeable placement over at least a portion of the proximal end of a key.

An additional important object of the present invention is the provision of a removable and exchangeable cover for the proximal end of a hotel or like key, which cover displays room or like identifying indicia.

An additional paramount object of the present invention is the provision of a key cover which obviates the need for die stamping site indicia directly on the proximal end of the key.

An additional dominant object of the present invention is the provision of a removable and exchangeable key cover which eliminates reliance upon bulky site identifying tag-chain-key combinations.

An additional important object of the present invention is the provision of a key cover which is readily removed from the proximal end of one key and placed upon the proximal end of another key in correspondence with rotation of locks from site to site.

It is a further principal object to provide a system for and related method of locks, keys and lock site identifying key covers which accommodate lock rotation between various sites and facile corresponding exchange of key covers.

These and other objects and features of the present invention will be apparent from the detailed description taken with reference to the accompanying drawings.

DETAILED DESCRIPTION OF THE ILLUSTRATED EMBODIMENTS

Figure 1:
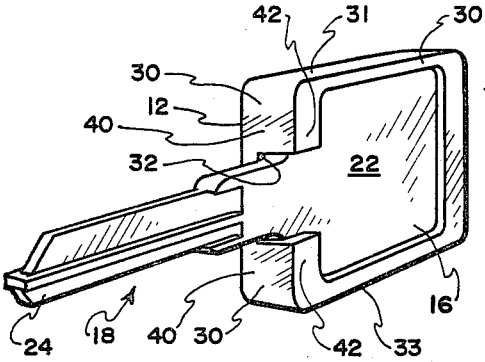
FIG. 1 is a perspective of the back side of a representation of one presently preferred key cover embodiment in accordance with the present invention with the key removably inserted into the cover.
Figure 2:
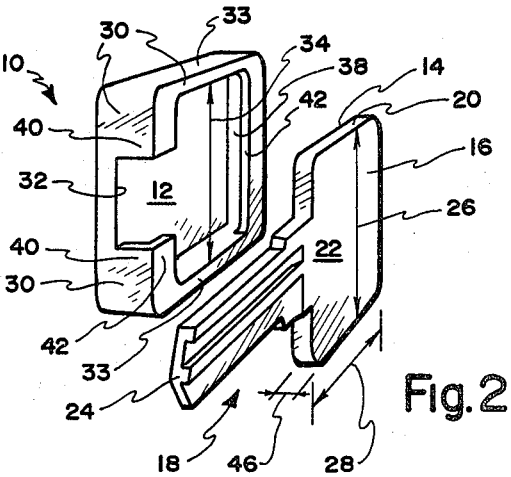
FIG. 2 is an exploded perspective of the key cover and key of FIG. 1.
Figure 3:
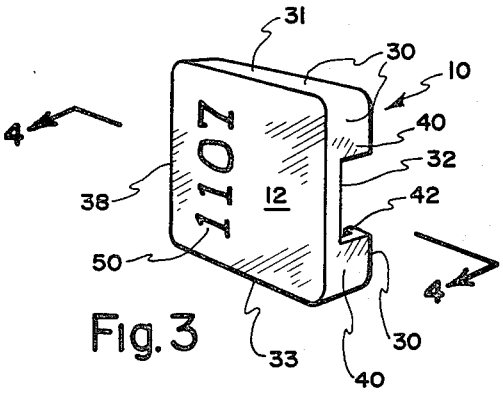
FIG. 3 is a perspective of the front side of the key cover of FIG. 1.

Reference is now made to the drawings wherein like numerals are used to designate like parts throughout. More particularly, FIGS. 1–4 illustrate one presently preferred key cover embodiment, generally designated 10, in accordance with the present invention. Key cover 10 is preferably of one piece injection molded synthetic resinous material and comprises a planar, relatively thin, flat sidewall 12, which contiguously covers, in the illustrated embodiment, the entire face 14 of the proximal end 16 of a hotel or like key, generally designated 18.

The proximal end of the key 18 comprises a peripheral edge 20 which traverses slightly less than 360 degrees around the perimeter of the proximal end 16 of the key 18, and an exposed key face 22. Key face 22 may carry indicia, a message or the like. The distal end 24 of the key 18 is adapted to fit within and open a specific lock, the tumblers of which, for example, have been previously set to receive and be opened by key end 24. The exact configuration and contours of the key end 24 do not comprise part of the present invention.

While any shape proximal key end may be used, the proximal end 16 of the key 18 is illustrated as being planar and generally rectangular if not square in configuration. The proximal key end 16 is illustrated as having a height dimension 26 of predetermined magnitude and an axial dimension 28 of predetermined amount.

Flat sidewall 12 of the key cover 10 integrally merges with a peripheral key cover edge flange 30, the width 45 of which is substantially greater than the width 46 of the key edge 20. The corners of the edge 30 are illustrated as being rounded. Transverse flange 30 is interrupted along its forward face by a front notch 32, sized and shaped to accommodate projection of the distal end 24 of the key 18, as illustrated in FIG. 1. Thus, the key cover 10 covers one entire face and substantially the entire peripheral edge of the proximal end 16 of the key 18.

The height 34 dimension between the top and bottom runs 31 and 33 of the flange 30 at the interior thereof is substantially identical to the height dimension 26 of the proximal end 16 of the key 18. The top and bottom runs 31 and 33 of the peripheral flange 30 thus freely though snugly receive in contiguous sliding relation the top and bottom edges of the proximal end 16 of the key 18.

The interior axial dimension 36 (FIG. 4) between the back and front runs of the peripheral flange 30 of the key cover 10 is substantially identical to the axial distance 28 of the proximal end 16 of the key 18. The back vertical run 38 and the front opposed runs 40 terminate in oppositely directed key retaining sidewall lips 42 which extend a relatively short distance contiguous with and parallel to the exposed surface 22 of the proximal end 16 of the key 18, when properly inserted into the key cover 10. See especially FIG. 4. Thus, the transverse dimension 44 between the sidewall 12 and the lips 42 is substantially the same as the width 46 of the proximal end 16 of the key 18.

Figure 4:
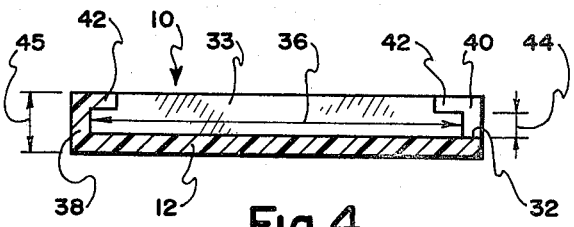
FIG. 4 is a longitudinal cross section of the key cover of FIG. 1 taken along lines 4—4 of FIG. 3.

The proximal end of the key is inserted into the key cover 10 by placing the rear run of the key edge 20 between rear lip 42 and the wall 12 against the rear edge run 38 of the key cover 10 with the key at a slight angle in respect to the plane containing wall 12. The exterior surface of the wall 12 is, for example, placed contiguously upon a flat surface, such as a desk or the like, and pressure is applied to the distal end 24 of the key 18 causing the key 18 to be rotated about a fulcrum comprising the trailing run 38 of the key edge 20 until the plane of the key becomes parallel to the plane containing the wall 12 of the key cover 10. This inherently displaces and deflects the yieldable forward lips 42 adjacent the opening 32 out of the path of the key under the force being applied to the key. The forward lips 42 thus snap over the forward peripheral edge of the proximal end of the key with the forward lips 42 thereafter returning to their unstressed normal positions as illustrated in FIG. 4 due to the memory of the material from which the key cover 10 is formed.

Thereafter, the described force-fit union between the key 18 and the key cover 10 is retained by engagement of the forward and rear lips 42 with the face 22 of the proximal end 16 of the key 18. However, application of sufficient opposite rotational force to the distal end 24 of the key 18 about the fulcrum comprising run 38 while manually grasping and retaining the key holder 10 will accommodate relative pivoting of the key 18 in respect to the holder 10 such that the forward lips 42 are outwardly deflected and displaced by the forward edge area of the proximal end 16 of the key 18 sufficient to permit separation of the key and the key cover. As hereinafter more fully described, the present invention embraces removal of key covers from various keys as keys and locks are rotated following which appropriate key covers are facilely exchanged and thereby installed upon keys which service locks located at specific locations or sites. More specifically, the key cover 10 is provided with a lock site identifying indicia 50. The lock site identifying indicia is illustrated as being hotel or motel room "1107." Thus, the key cover 10 will always be force-fit in superimposed partially encapsulating removable relation upon the proximal end of whatever key is currently being used to service the lock on the door of room "1107."

It is to be appreciated that on the exterior surface of the wall 12 may also be carried any type of display desired including the name and address of the hotel or the like involved, the instructions that postage is guaranteed for return of the key through the mails.

Figure 5:
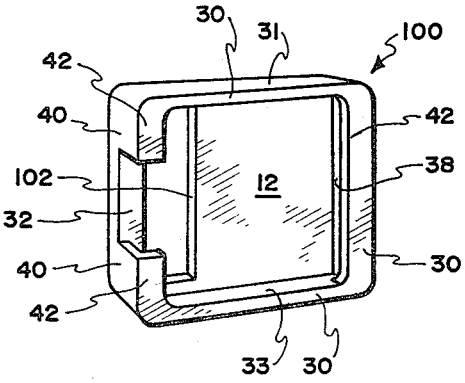
FIG. 5 is a perspective representation of the back side of a second presently preferred key cover embodiment in accordance with the present invention.
Figure 6:
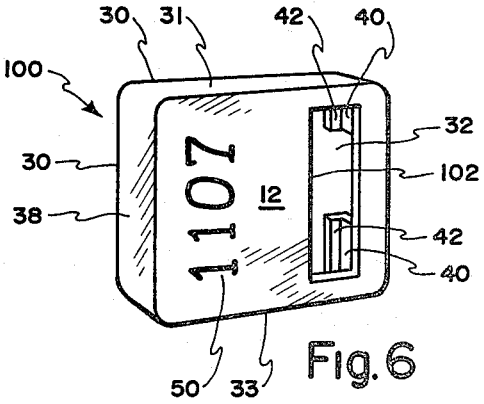
FIG. 6 is a perspective representation of the front side of the key cover of FIG. 5.

Reference is now made to FIGS. 5 and 6 which illustrate a second presently preferred key cover embodiment, generally designated 100, according to the present invention. Key cover 100 is illustrated as being identical to the previously described key cover 10, with a single exception, i.e. an opening or window 102 exists in the wall 12. The opening 102 is illustrated as being rectangular in configuration, but may be shaped otherwise as desired. The purpose of the window 102 is to expose to view non-room identifying indicia or a message carried upon the surface 14 of the proximal end 16 of the key 18. Such indicia may be the previously mentioned return postage guarantee. Otherwise, the structural features and method of use of the key cover 100 is identical to that described in conjunction with key cover 10.

Figure 7:
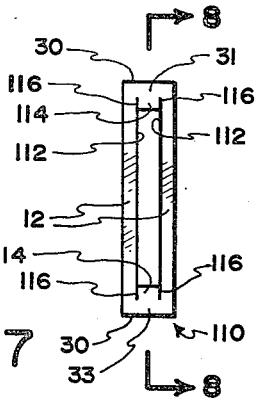
FIG. 7 is an end view of a third presently preferred key cover embodiment with no key inserted.
Figure 8:
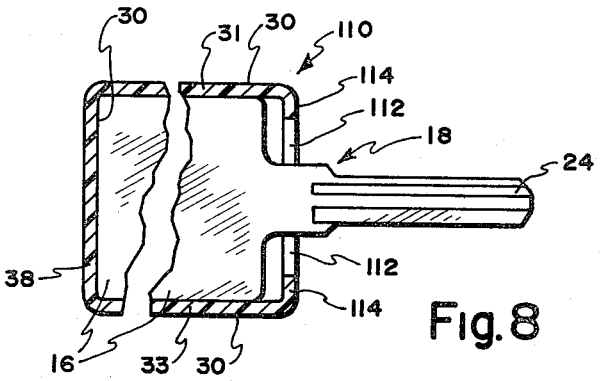
FIG. 8 is a cross sectional view taken along lines 8—8 of FIG. 7 and further illustrating a key contained within the cover.

Reference is now made to FIGS. 7 and 8 which illustrate a third presently preferred key cover embodiment, generally designated 110, according to the present invention. Key cover 110 instead of having one side generally open is closed on both sides by parallel spaced walls 12, each of which is illustrated as being identical to wall 12 of the key cover 10 previously described. The two walls 12 are held in the illustrated parallel spaced relation by a transverse peripheral edge 30 which comprises upper run 31, lower run 33 and trailing or back run 38. Thus, when installed, the proximal end 16 of the key 18 will be snugly contiguous with the interior surface of the edge runs 31, 33 and 38, as illustrated in FIG. 8.

The forward end of the key cover 110, which key cover is formed of one piece injection molded synthetic resinous material, such as polyethylene, comprises a relatively large slot 112 the vertical dimension of which is slightly less than the vertical dimension 26 of the proximal end 16 of the key 18. The top and bottom edge runs 31 and 33, respectively, terminate in 90 degree opposed flaps 114 which are directed downwardly and upwardly, respectively toward the center of the opening 112 of the key cover 110. Flaps 114 each comprise spaced parallel slits 116 (FIG. 7) cut or otherwise fabricated to form a thin line of separation between each wall 12 and the associated flaps 114. Thus, each flap 114 functions as an integral hinge accommodating displacement and deflection thereof upon linear insertion of the proximal end 16 of the key 18 through the relatively large slot 112. Thereafter the flaps 114 return (due to the memory of the material from which the key cover 110 is made) to their original unstressed position, which is illustrated in FIG. 8. Key removal is accommodated in reverse by merely grasping the key cover in one hand and linearly pulling the key by its distal end 24 out of the opening 112, at which time the flaps 114 are oppositely outwardly deflected and displaced to accommodate key removal. Key cover 110 carries exposed lock site identifying indicia.

From the foregoing it is apparent that the present invention comprises key covers, a key-key cover system and related method wherein a plurality of keys and locks are provided with the locks being disposed at different locations or sites at any point in time. The locks are, for security or other reasons, rotated between sites from time to time and the keys correspondingly rotated. Each lock site identifying key cover which wholly or partially encapsulates only the proximal end of the associated key is readily manually removable from any given key upon its rotation and is thereafter force-fit upon the key next assigned to the lock site identified on the exterior of the key cover. It is, therefore, an achievement of the present invention to avoid the requirement of die stamping room numbers and other lock location identifying indicia directly upon keys or placing such upon tags required to be attached to keys by chains and the like.

The invention may be embodied in other specific forms without departing from the spirit or essential characteristics thereof. The present embodiments are therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. A key-key cover system comprising:

a plurality of keys and locks at diverse sites respectively serviced by the keys;

a plurality of removable, exchangeable and repeatedly reuseable key covers of one-piece construction comprising synthetic resinous material;

each reuseable key cover comprising;

body means of one piece construction formed of molded shape retaining non-foldable synthetic resinous material with memory;

the body means comprising sidewall means generally coextensive with and substantially covering one face of the handle end of the key when inserted;

the body means further comprising forward and rear edge wall means spaced a distance substantially the same as the axial length of the handle end of the key thereby preventing fore and aft relative axial displacement of the key in the cover, the sidewall means and the edge wall means defining a key handle receiving cavity having a uniform and uninterrupted width throughout the length and width of the cavity being substantially the same as the length and width of the key handle;

the sidewall means integrally merging with the forward and rear edge wall means;

flange means integrally merging with the edge wall means, extending inwardly from the edge wall means parallel to and spaced from the sidewall means by a distance substantially the same as the thickness of the key handle;

the cavity comprising a key handle end insertion and removal opening;

each key cover displaying the present site location of the lock serviced by that key;

locks and the respective keys thereto being exchanged from time to time by removing the key from each key cover via said opening and placing it upon a different key the lock of which has been transferred to the locked site displayed upon the key cover.

2. A removable, exchangeable and repeatedly reusable key cover partially but not totally enclosing the handle end of the key comprising;

body means of one piece construction formed of molded shape retaining non-foldable synthetic resinous material with memory;

the body means comprising sidewall means generally coextensive with and substantially covering one face of the handle end of the key when inserted;

the body means further comprising forward and rear edge wall means spaced a distance substantially the same as the axial length of the handle end of the key thereby preventing fore and aft relative axial displacement of the key and the cover, the forward edge wall defining two sides of a three sided groove having an area substantially the same as the area of the shank of the key, the third side of the groove being formed by the sidewall means with the groove laterally receiving the key shank adjacent the handle end of the key;

the sidewall means integrally merging with the forward and rear edge wall means;

lip means integrally merging with the edge wall means, extending inwardly from the edge wall means and spaced from the sidewall means by a distance substantially the same as the thickness of the handle end of the key;

the edge wall means, the sidewall means and the lip means forming therebetween a key handle end receiving cavity sized and shaped to laterally receive the handle end of the key in snug relationship;

the cavity being laterally spaced at a key handle end insertion and removal opening, the opening being defined at least in part by the lip means whereby the handle end and the shank may be generally simultaneously transversely inserted into and removed from the cavity and the groove via the opening.

3. A key cover according to claim 2 wherein the sidewall means comprises one relatively flat thin wall covering at least a substantial part of one face of the handle end of the key.

4. A key cover according to claim 3 wherein the one flat thin sidewall comprises at least one opening by which indicia carried upon the key is displayed.

5. A key cover according to claim 3 wherein the flat thin sidewall comprises a window.

6. A key cover according to claim 2 further comprising indicia carried for visual observation on the exposed exterior of the sidewall means.

7. A key-key cover system comprising:

a plurality of keys and locks respectively serviced by the keys, the locks being disposed initially at different sites and rotated between sites from time to time, the keys having substantially identical handle ends;

a plurality of removable, exchangeable and repeatedly reusable shape retaining key covers of synthetic resinous material, each key cover comprising:

body means of one piece construction formed of molded shape retaining non-foldable synthetic resinous material with memory;

the body means comprising sidewall means generally coextensive with and substantially covering one face of the handle end of the key when inserted;

the body means further comprising forward and rear edge wall means spaced a distance substantially the same as the axial length of the handle end of the key thereby preventing fore and aft relative axial displacement of the key and the cover, the forward edge wall defining two sides of a three sided groove having an area substantially the same as the area of the shank of the key, the third side of the groove being formed by the sidewall means with the groove laterally receiving the key shank adjacent the handle end of the key;

the sidewall means integrally merging with the forward and rear edge wall means;

lip means integrally merging with the edge wall means, extending inwardly from the edge wall means and spaced from the sidewall means by a distance substantially the same as the thickness of the handle end of the key;

the edge wall means, the sidewall means and the lip means forming therebetween a key handle end receiving cavity sized and shaped to laterally receive the handle end of the key in snug relationship;

the cavity being laterally exposed at a key handle end in tion and removal opening, the opening being defined at least in part by the lip means whereby the handle end and the shank may be generally simultaneously transversely inserted into and removed from the cavity and the groove via the opening.

8. A removable, exchangeable and repeatedly reuseable key cover substantially enclosing the handle end of a key comprising:

body means of one-piece construction formed of molded shape retaining non-foldable synthetic resinous material with memory;

the body means comprising two sidewall means spaced from each other a distance substantially the same as the thickness of the handle end of the key and generally coextensive with and substantially covering the opposed faces of the handle end of the key when inserted;

the body means further comprising forward and rear edge wall means integral with the two sidewall means and spaced a distance from each other substantially the same as the axial length of the handle end of the key thereby preventing fore and aft relative axial movement of the key and the cover when the key is fully inserted, the forward edge wall defining a four sided groove having an area substantially the same as the area of the handle end of the key and flaps extending into the groove which may be folded fore and aft for axial insertion and removal of the handle end of the key.

* * * * *